US005474414A

United States Patent [19]

Tovini et al.

[11] Patent Number: 5,474,414

[45] Date of Patent: Dec. 12, 1995

[54] AUTOMATIC CONTENT SEPARATING SYSTEM

[75] Inventors: Gianluca Tovini, Norwalk; James E. Foley, Easton, both of Conn.

[73] Assignee: Agissar Corporation, Stratford, Conn.

[21] Appl. No.: 311,139

[22] Filed: Sep. 23, 1994

Related U.S. Application Data

[63] Continuation of Ser. No. 923,832, Aug. 3, 1992, Pat. No. 5,374,152.

[51] Int. Cl.[6] ..... B65B 43/30

[52] U.S. Cl. ..... 414/412; 271/183; 83/912; 53/381.3; 53/381.6

[58] Field of Search ..... 414/411, 412, 414/403, 418, 416; 271/183; 53/381.3, 381.5, 381.6, 381.7, 381.2, 381.4; 83/912

[56] References Cited

U.S. PATENT DOCUMENTS

| | | | |
|---|---|---|---|
| 3,384,252 | 5/1968 | West | 83/912 X |
| 4,586,311 | 5/1986 | Becherer et al. | 414/412 X |
| 4,866,908 | 9/1989 | Kunne et al. | 53/381.6 |
| 5,147,169 | 9/1992 | Miller et al. | 414/412 X |
| 5,156,515 | 10/1992 | Charron et al. | 414/412 |
| 5,188,504 | 2/1993 | Nelson | 414/412 X |

FOREIGN PATENT DOCUMENTS

| | | | |
|---|---|---|---|
| 199837 | 8/1989 | Japan | 414/412 |

*Primary Examiner*—Frank E. Werner
*Attorney, Agent, or Firm*—Melvin I. Stoltz

[57] ABSTRACT

A substantially enhanced and improved automated mail or envelope handling system is obtained by incorporating therein the envelope content separating or staggering system of this invention. By positioning separating means in the envelope content pathway which cooperate with the envelope contents to physically separate and/or longitudinally stagger one content element relative to the second content element, the staggered portion of the rear element is easily readable by the operator in addition to the readability of the forward element. In this way, the operator is able to initiate processing of the envelope contents without being required to physically remove and separate the elements before processing the information. In the preferred embodiment, vacuum means are employed to attract and hold one of the content elements for a pre-determined duration of time, while the other element continues to advance. In this way, the desired longitudinally separation is efficiently attained.

7 Claims, 6 Drawing Sheets

AUTOMATIC CONTENT SEPARATING SYSTEM

This application is a continuation of application Ser. No. 07,923,832, filed Aug. 3, 1992, now U.S. Pat. No. 5,374,152.

TECHNICAL FIELD

This invention relates to envelope or mail handling systems and more particularly to mail handling systems which separate pre-slit envelopes and staggers or separately positions the contents thereof relative to each other for ease of viewability and processing.

BACKGROUND ART

Due to the ever increasing demand by numerous businesses for efficient mail handling equipment, many systems have been developed in an attempt to automatically receive envelopes, slit the envelope open, and present the contents thereof in a manner which is most efficiently handled by an operator. Although these prior art systems have been reasonably efficient in receiving the envelopes and slitting the envelopes open, substantial difficulty has been encountered in separating the slit envelope and presenting the contents thereof reliably and repeatedly in a manner which is conveniently presented to an individual for ease of checking and processing, with a minimum of direct handling.

Although various prior art systems have been developed to meet the needs of industry, these prior art attempts have been unable to provide an envelope handling system which is capable of repeatedly and reliably separating the pre-slit envelopes and presenting the contents in a manner which is easily viewed by the operator for fast and efficient checking and processing. One typical prior art method is to blow air into the pre-slit envelope in an attempt to enable the operator to reach in and remove the contents therefrom. However, this system has proven to be extremely slow, as well as inefficient in opening the envelope sufficiently for consistent and repeatable access by the operator. In addition, viewability of the contents prior to removal is not provided.

Other prior art systems have employed a vacuum to draw the sides of the envelope away from each other while the contents of the envelope are to remain stationary until captured by a track or reached by the operator for removal. One type of these prior art vacuum systems employ vacuum ports which are positioned perpendicularly to the line of travel of the envelope in juxtaposed spaced facing relationship to each other. However, in use, it has been found that this prior art system is incapable of repeatedly, consistently, and reliably maintaining the contents in the desired orientation or properly opening the envelope. Furthermore, viewability of the contents without removal is not possible.

In addition, this type of prior art vacuum system has been found to be incapable of drawing only the sides of the envelope, without also adversely affecting the contents thereof. Consequently, both the contents and the envelope side are often drawn to the vacuum, causing the contents to be improperly positioned and requiring special attention by the operator. Furthermore, this type of prior art vacuum system is extremely noisy, in view of the high level of suction required to drawn the envelopes to the vacuum head.

One prior art system, which has been developed, has been particularly effective in providing an envelope handling system which separates the envelope sides repeatedly and efficiently, while presenting the contents thereof in a separate channel for ease of access by the operator. This system is disclosed in U.S. Pat. No. 5,052,875. Although this prior art system has proven to be extremely efficient in its overall operation, neither this system nor any other prior art system has been able to effectively stagger or separate the contents of the envelope in a manner which enables the contents to be easily viewed by the operator, prior to the removal from the track.

One of the principal difficulties that has been encountered in using even this most efficient prior art system is the requirement that the operator physically remove the envelope contents from its transfer pathway for viewing before processing can begin. In most instances, the contents of the envelopes consists two sheets of paper, one being the statement and the other being the check. After removal of these items from the pathway, the operator must separate these two pieces of paper and then visually check the amount shown for the payment due as well as the amount of the payment being made to assure that the two amounts are equal. Then, the information is able to be processed.

If the contents of the envelope were separated from each other so that they can be independently used, the operator would be able to perform many processing steps without first handling the contents. Although the physical separation of the contents from each other is highly desirable, no prior art system has been developed which is capable of attaining this result.

Furthermore, it has also been found that some operators experience hand discomfort due to the repetitive nature of removing the contents from its transfer pathway and manually separating the contents from each other. These repetitive manual manipulations have caused some individuals to incur various episodes of carpal tunnel syndrome.

Therefore it is a principal object of the present invention to provide an automated envelope handling system which is capable of consistently separating a pre-slit envelope from the contents thereof, and repeatedly and reliably longitudinally staggering or separating the envelope contents to enable independent, simultaneous viewability of the two separate sheets of paper typically contained therein.

Another object of the present invention is to provide an automated envelope handling system having the characteristic features described above, which is capable of operating at a substantially reduced decibel or noise level, thereby providing a system which is comfortable for the operators to use.

Another object of the present invention is to provide an automated envelope handling system having the characteristic features described above, which substantially eliminates mishandling of the envelope contents and enables the operator to simultaneously view both a statement and a check before any handling of the contents by the operator is required.

Another object of the present invention is to provide an automated envelope handling system having the characteristic features described above which substantially reduces the manual operations being performed by an operator and substantially eliminates the likelihood of an operator developing carpal tunnel syndrome.

Other and more specific objects will in part be obvious and will in part appear hereinafter.

SUMMARY OF THE INVENTION

The present invention overcomes the prior art drawbacks and shortcomings by providing a uniquely constructed system for automatically separating and/or staggering the contents of the envelope, while having no effect on the normal advance of the envelope itself. In most applications which employ an automated mail handling system, the contents of most envelopes consists of a statement and a check. By providing a system which automatically staggers or longitudinally separates these two items, so that the rear item or element extends longitudinally outwardly from the top item or element, the operator is able to easily, quickly and conveniently process these items, without being required to physically handle or touch the items. As a result, physical handling and repetitive hand movements are virtually eliminated, along with the medical difficulties found in the prior art.

In most instances, the envelope contents are properly oriented, thereby enabling the operator to easily see all of the necessary information once the contents has been staggered. In those few situations in which one of the items or content elements is not properly oriented, the operator merely corrects the orientation before processing.

In most applications, the operator records the payments being made. By employing the means of this invention for staggering or longitudinally separating the envelope contents relative to each other, an operator is able to view virtually all of the information necessary for making the requisite entries, without ever having to physically handle the envelope contents, in most situations. In this way, speed and efficiency are enhanced and the hand operations required by the operator are substantially reduced, thereby further improving operator speed and virtually eliminating unnecessary, repetitive operator handling steps.

In the preferred embodiment of the present invention, the envelope is pre-slit along three of its four edges and opened using any one of the plurality of the prior art systems presently available. Regardless of which system is employed, the envelopes are advanced along one path, while the envelope contents are channeled into a separate transfer path.

In employing the present invention, content staggering or longitudinal separating means are mounted in the envelope content transfer pathway and positioned for acting upon the envelope contents to achieve the desired staggering or longitudinal separation thereof. Preferably, the content staggering occurs near the beginning of the content transfer pathway in order to optimize the time duration through which the operator is able to benefit from the simultaneous viewability of both content elements.

In carrying out the present invention, various alternate systems can be used to achieve the desired content staggering and/or separation. However, it has been found that direct mechanical action or a vacuum system are the most effective means by which the desired results are attained.

In the preferred embodiment, a vacuum system is employed for acting directly upon the rear element or document forming one of the envelope's contents. In the preferred construction, a tube or aperture-bearing member is positioned in direct association with the rear plane of the pathway through which the envelope contents move. The tube or aperture-beating member is connected to a vacuum source, and thereby provides a force which draws the rear document towards the tube or apertured member until the document is held against the tube or apertured member, thereby stopping its advance, while the forward document continues to advance in its normal manner. In this way, the system assures that only the rear document is held by the vacuum means while also releasing the held document after a pre-selected time period.

Once the preset period of time has elapsed, the vacuum is eliminated and the rear document automatically continues to advance in its otherwise normal manner. However, by holding and preventing the rear document from advancing during this predefined time period, while the forward document is allowed to advance normally, the rear document becomes staggered relative to the forward document.

In this way, the two element contents of the envelope are efficiently, reliably and effectively staggered or longitudinally separated, while the rear document extends longitudinally outwardly from the terminating edge of the forward document by the precise amount desired. As a result, both documents are easily seen simultaneously, and the operator is able to perform initial processing steps conveniently and easily, without being required to manually handle the envelope contents.

The invention accordingly comprises the features of construction, combination of elements and arrangement of parts which will be exemplified in the constructions hereinafter set forth and the scope of the invention will be indicated in the claims.

THE DRAWINGS

For a fuller understanding of the nature and objects of the invention, reference should be had to the following detailed description, taken in connection with the accompanying drawings in which.

DETAILED DESCRIPTION

In FIGS. 1–4, the preferred embodiment for the envelope content staggering or separating system 20 of the present invention is depicted mounted in direct association with envelope handling system 21. Envelope handling system 21 is substantially identical to the envelope handling system depicted in U.S. Pat. No. 5,052,875. However, envelope handling system 21 has been modified by incorporating improvements, which are detailed herein, along with the incorporation of content staggering or separating system 20.

Figure 1:
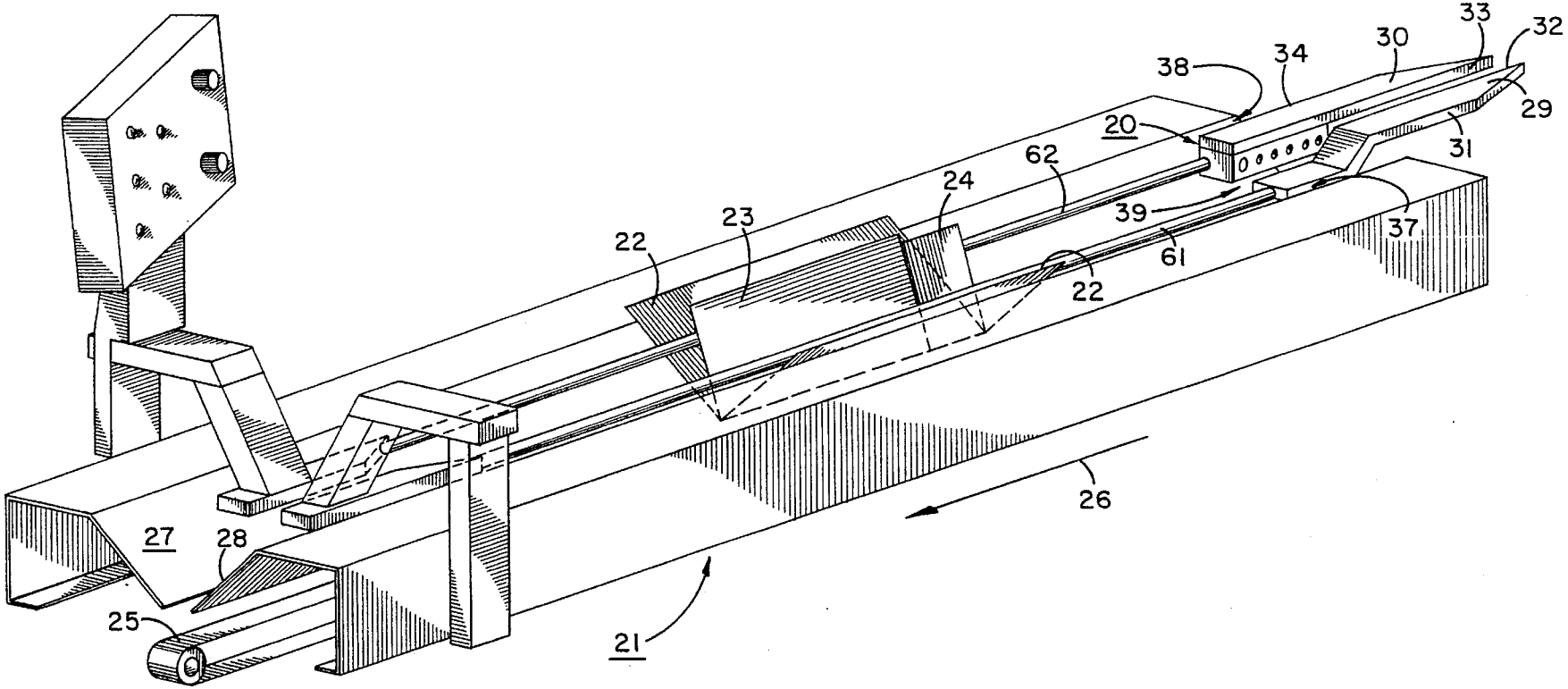
FIG. 1 is a perspective view of a typical envelope handling system incorporating the content staggering system of the present invention with a pre-slit envelope and the contents thereof depicted after passage through the staggering system.

In FIG. 1, envelope 22 is depicted with its content elements 23 and 24 shown after passage by staggering system 20. By employing staggering system 20, rear content element 24 is longitudinally extended beyond the terminating edge of forward content element 23. In this way, the entire front surface of content element 23 and a substantial portion of the front surface of content element 24 can be viewed simultaneously by the operator.

By employing system 20, virtually all physical handling of the content elements 23 and 24 is eliminated. First, the operator visually checks the information displayed on content elements 23 and 24. In most instances, the content elements are properly oriented, and no physical contact by the operator is required. In this typical situation, the operator merely inputs the desired information into the associated equipment, without having to physically handle content elements 23 and 24 and, once completed, allows the content elements to proceed to an automatic stacking system. As a result, speed and efficiency of the operator are enhanced and the manual steps and repetitive hand motions, previously required by the operator, are totally eliminated.

In those instances in which the contents are not properly oriented, the operator is able to easily recognize this problem and merely corrects the orientation manually. Then, processing continues quickly and easily.

Although the content staggering or longitudinal separating system of the present invention is applicable to all high speed mail handling systems and the type of mail processed by these systems, the present invention is depicted and discussed herein for use with conventional envelopes and the contents thereof as typically processed by most companies for customer payments. In virtually all such applications, the contents of the envelopes comprise two elements, consisting of the statement showing the amount owed by the customer and the check submitted by the customer for payment.

In addition, in most such applications, window envelopes are employed by the customer when submitting their payment for the outstanding services. As a convenience to their customers, most companies imprint the company's name and address as a portion of the statement, in order to enable the customer to conveniently place the statement portion in position with the window portion of the envelope for being viewed therethrough. As a result, all such envelopes, when processed, will have the statement portion as the forward element and the check or payment as the rear element forming the contents thereof.

It is this conventional application and traditional envelope and content configuration to which the present disclosure is particularly directed. However, as will be apparent from the detailed disclosure herein, and the construction and operation of the content staggering system of this invention, the present invention is not specifically limited to this construction and can be used with equal efficacy for separating any alternate content construction or configuration.

Mail handling system 21 operates continuously to transport envelope 22 and content elements 23 and 24 through system 21 until content elements 23 and 24 are removed for processing, while envelope 22 is transferred for disposal. In order to attain this continuous transfer motion, the section of mail handling system 21 depicted in FIGS. 1–4 incorporates a transfer belt 25, which is continuously moving during normal mail handling in order to assure that envelope 22 and content elements 23 and 24 advance in the direction of arrow 26.

As is fully detailed in U.S. Pat. No. 5,052,875, envelope 22 advances through mail handling system 21 on belt 25 by being moved in the direction of arrow 26 after envelope 22 has been slit along three of its four sides. As envelope 22 passes between vacuum manifolds 35 and 36, the side walls of envelope 22 are drawn into contact with the surfaces of manifolds 35 and 36, thereby causing the sides of envelope 22 to be drawn away from each other and maintained in this spaced apart position until the envelope sides have been independently brought into contact with separator tracks 29 and 30.

Figure 2:
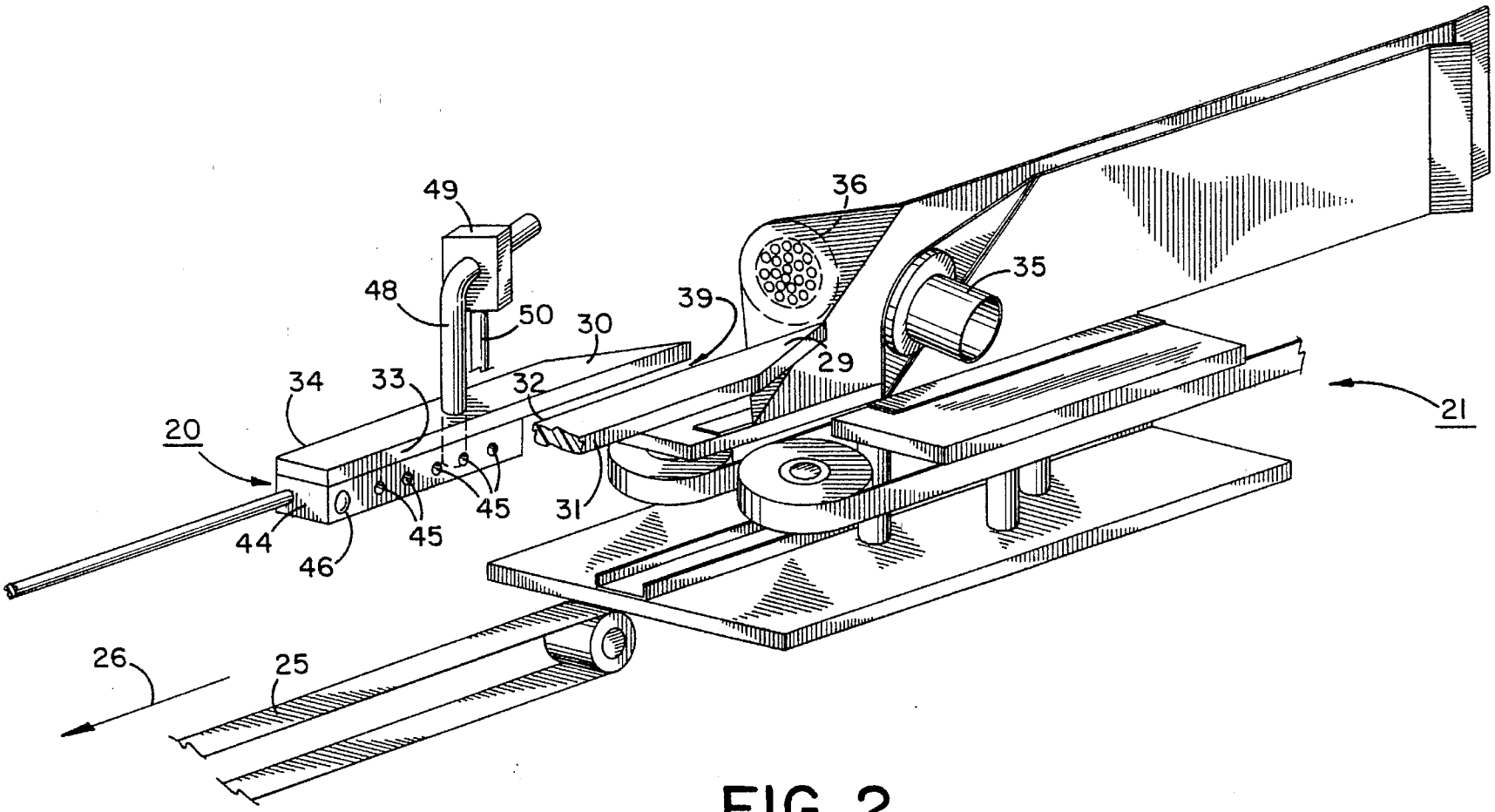
FIG. 2 is a perspective view, partially broken away, of the portion of the envelope handling system incorporating the content staggering system of this invention.

As best seen in FIGS. 1 and 2, separator track 29 comprises an outside edge 31 and an inside edge 32, while separator track 31 comprises an inside edge 33 and an inside edge 34. By employing two separator tracks 29 and 30, separate and independent channels or transfer pathways 37, 38 and 39 are established. Pathway 37 is defined by edge 31 of separator track 29 and side panel 28 of mail handling system 21, while transfer pathway 38 is established between outside edge 34 of separator track 30 and side panel 27 of mail handling system 21. Finally, channel or pathway 39 is established between juxtaposed, spaced, facing edge 32 of separator track 29 and edge 33 of separator track 30. In this way, three separate and distinct channels or pathways are provided for the efficient, secure, independent movement of each side wall of envelope 22 and content elements 23 and 24 in precisely desired separate, independent pathways.

In the preferred embodiment, the desired staggering or longitudinal separation of content elements 23 and 24 is provided by mounting vacuum staggering system 20 to separator track 30 of mail handling system 21. As depicted in FIGS. 1 and 2, content staggering system 20 incorporates a housing 44 which comprises a sealed interior plenum or chamber, which is connected to a plurality of outlets 45 formed along the side of chamber 44 in juxtaposed, spaced, facing relationship with channel or pathway 39. In addition, a switch means 46 is also mounted in housing 44 positioned along the same face as outlets 45. Preferably, switch means 46 comprises a photosensor and is positioned directly adjacent the terminating end of housing 44, for being activated whenever the presence of the content elements 23 or 24 is sensed. Although this construction is preferred, alternate constructions and switch arrangements can be employed, without departing from the scope of this invention.

The construction of content staggering system 20 is completed by interconnecting the interior chamber or plenum of housing 44 to a vacuum source. In this way, once the vacuum source has been activated, a vacuum or negative force is applied to outlets 45, causing rear content element 24 to be drawn into contact and holding engagement therewith. In the preferred construction, support tube 48 is formed from hollow material, with one end thereof communicating with the interior of the sealed chamber of housing 44, while the opposed end thereof is connected to the vacuum source.

Tube 48 is also securely affixed to separator track 30 for securely maintaining track 30 in the precisely desired position. In order to assure that track 30 is maintained in the desired position, tube 48 is retained within support block 49 which is held by support post 50. Post 50 extends from the shown position to a securement point (not shown) with mail handling system 21. In this way, track 30, block 49, and tube 48 are all securely held in their respective desired positions.

Figure 3:
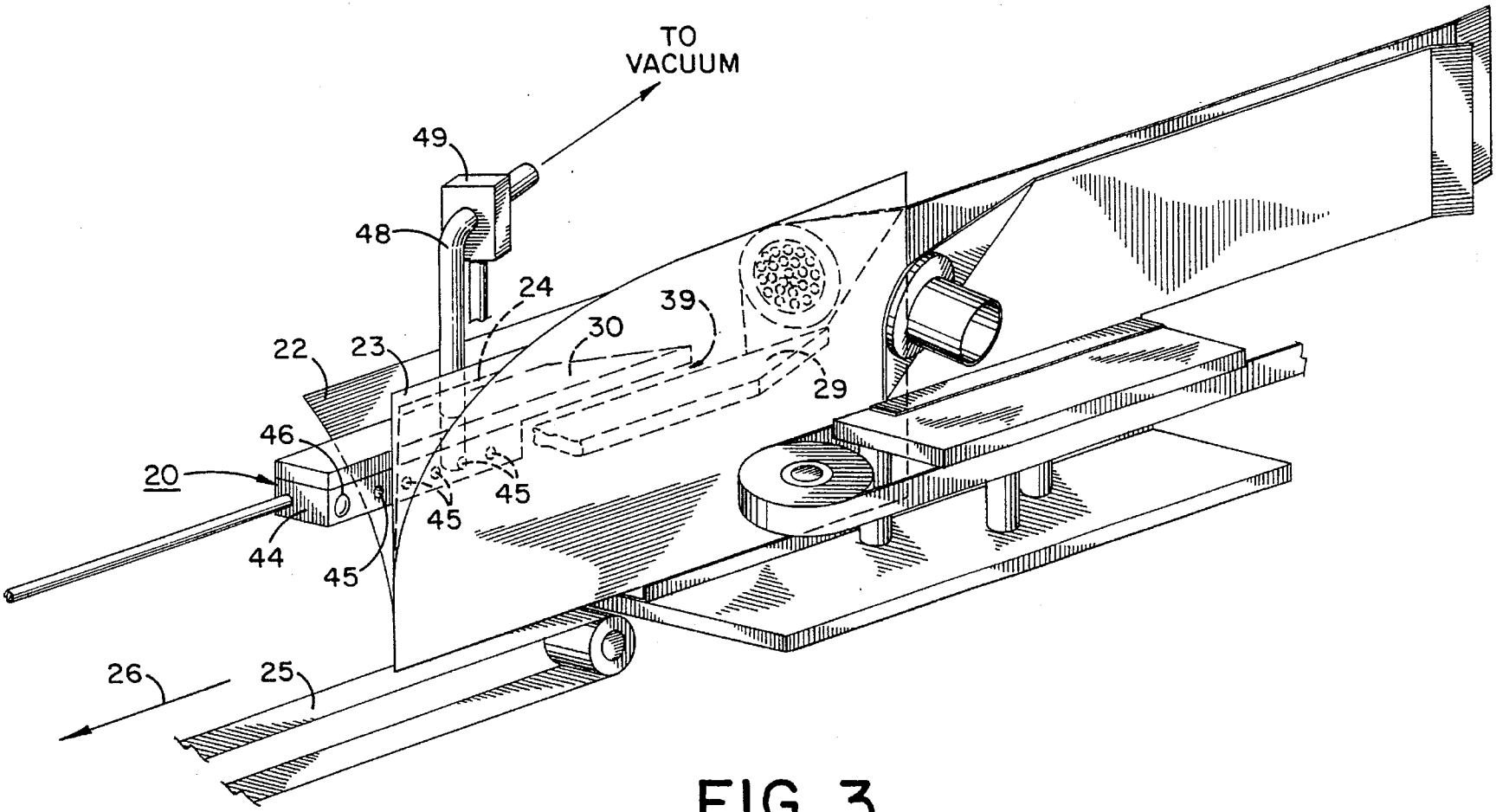
FIGS. 3 and 4 are perspective views, similar to the perspective view of FIG. 2 showing a pre-slit envelope and its contents at various stages during its passage through the content staggering system of this invention.
Figure 4:
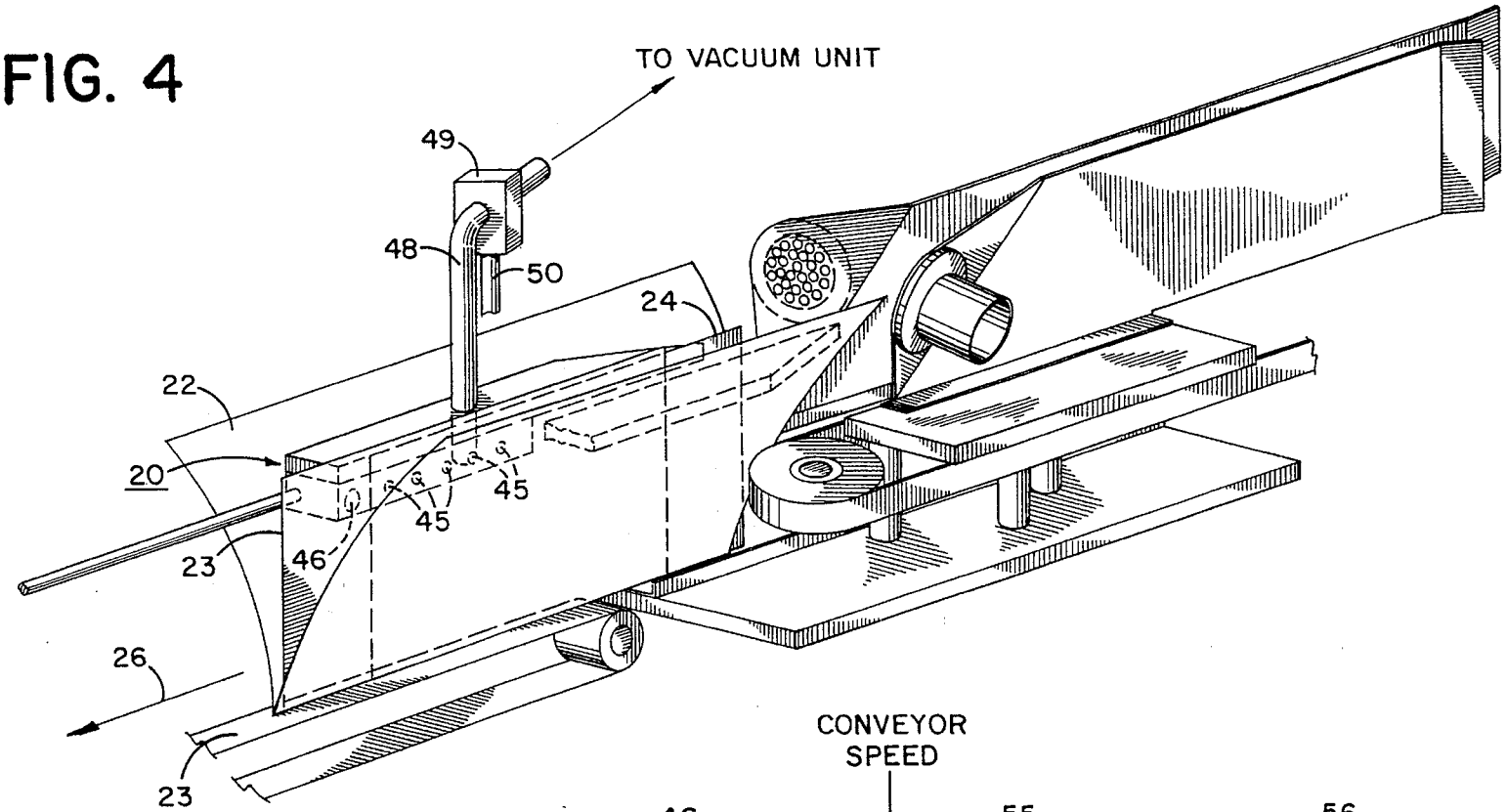

By referring to FIGS. 3 and 4, along with the following detailed disclosure, the operation of content staggering system 20 of this invention can best be understood. In FIG. 3, envelope 22 is depicted after slitting and separation into the three independent channels or transfer pathways of mail handling system 21. For purposes of clarity in fully understanding the construction and operation of staggering system 20, structural details of mail handling system 21 have been eliminated from FIG. 3.

As shown in FIG. 3, content elements 23 and 24 advance through channel 39 with rear content element 24 passing outlets 45 of staggering system 20. In this preferred embodiment, switch means 46 is mounted at the terminating end of housing 44 of vacuum staggering system 20 in order to prevent the premature activation of the vacuum system.

In normal operation, content elements 23 and 24 advance in channel 39 until the leading edge of content element 23 or 24 passes over switch means 46. In the preferred embodiment, switch means 46 comprises a photosensor, which is activated by the reflection of its own light caused by content elements 23 and 24 passing thereover. In addition, switch means 46 is controllably connected to the vacuum source, preferably by a solenoid valve which is responsive to switch means 46.

By employing this construction, content elements 23 and 24 activates switch means 46, causing the vacuum line solenoid valve to be open and the vacuum force to be applied to outlet 45 of vacuum system 20. As shown in FIG. 4, this negative pressure or vacuum source causes rear content element 24 to be drawn against housing 44 of vacuum system 20 and to be held in this position, while forward content element 23 continues to advance on belt 25 in channel 39.

Once activated, the vacuum solenoid valve remains open for a preset duration of time and then automatically closes. Once the solenoid valve is closed and the vacuum source has been shut off, rear content element 23 is free to continue to advance along belt 25 in channel 39. However, since the movement of rear content element 24 is suspended for the preset time interval, rear content element 24 is staggered or longitudinally extends beyond the terminating edge of forward content element 23 by a length equivalent to the distance traveled by forward content element 23 during the vacuum application time duration. The resulting, staggered or longitudinally extended configuration of content element 24 relative to content element 23, as the contents and envelope 22 advance along mail delivery system 21, is depicted in FIG. 1.

In order to attain the desired control over the operation of staggering system 20 of the present invention, the force of the vacuum being applied at apertures 45 of staggering system 20 is preferably variable. In this way, assurance is provided that only rear content element 24 is drawn and held in contact with staggering system 20, in the desired manner, while preventing forward content element 23 from being simultaneously drawn into contact therewith. By incorporating adjustable control means, the precise vacuum required for attaining the desired results is realized.

Figure 5:
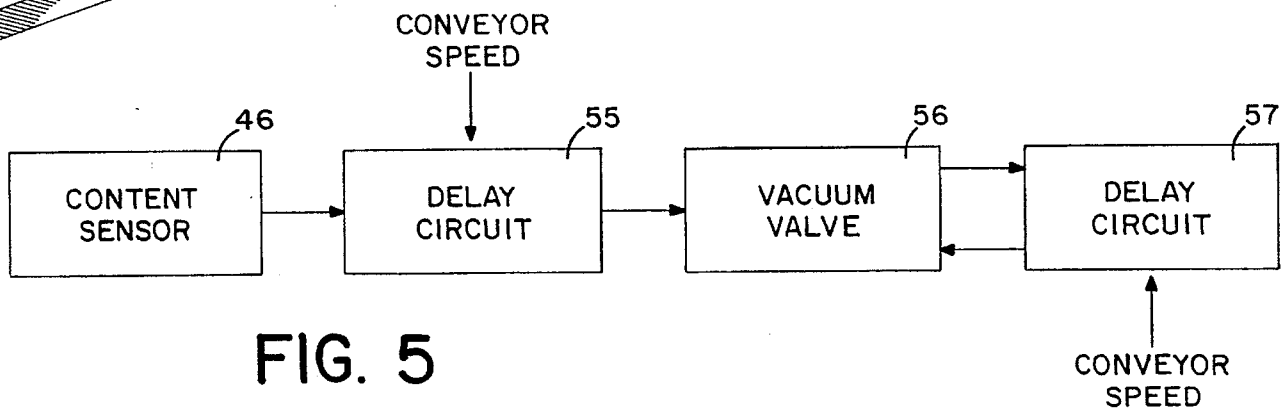
FIG. 5 is a schematic block diagram showing the control circuitry employed in the content staggering system of the present invention.

In FIG. 5, a schematic block diagram of the system is provided showing the preferred construction and operation control of circuitry for content staggering system 20 of the present invention. As shown therein, the circuit is initiated by content sensor or switch 46 which is activated only when either content element 23 or 24 passes over sensor 46. Once activated, content sensor 46 preferably transmits a signal to adjustable delay circuit 55, which introduces a desired time delay, before vacuum solenoid valve 56 is open to allow the vacuum to be applied to tube 48 and apertures 45 of staggering system 20.

The incorporation of delay circuit 55 is employed to assure that all types of content conditions can be easily satisfied. As discussed above, content element 23 typically comprises the statement with the address printed thereon appearing through the window of envelope 22, while rear content element 24 comprises the check. In many applications, the statement comprises an overall length substantially greater than the length of most checks.

In order to assure that this condition is easily handled by staggering system 20, delay circuit 55 is employed to control the timing for the activation of the vacuum source. In this way, the opening of solenoid valve 56 by the passage of the leading edge of forward content element 23 across switch 46 is delayed until such time as the leading edge of rear content element 24 is likely to have advanced over outlets 45.

In the preferred construction, the speed of conveyor belt 25 is controlled by the operator and monitored by delay circuit 55, to assure that the time delay provided by circuit 55 will provide consistent results regardless of the speed selected. In this way, assurance is provided that consistent, repeatable and dependable results are attained. In order to further enhance the dependability of this invention, staggering system 20 preferably incorporates a plurality of outlets 45 to increase the efficiency of the suction force provided by the outlet.

Once vacuum valve 56 has been opened to apply the vacuum to staggering system 20, a second delay circuit 57 is automatically activated for controlling the time duration during which vacuum valve 56 will remain open. As with delay circuit 55, delay circuit 57 is completely adjustable, in order to accommodate any particular arrangement or content configuration.

In most applications, rear content element 24 comprises the payment check, which requires between about 1 to 3 inches of content element 24 to be staggered or longitudinally extended beyond the terminating edge of forward content element 23, in order to assure its ease of readability. Since most check configurations have the payment amount positioned at the right-hand edge of the check, the visibility of between 1 to 3 inches has been found to be sufficient to enable the operator to perform all of the visual checking required prior to actually handling the statement and the check.

In addition to the actual length desired for rear content element 24 to be visible, the time duration set into delay circuit 57 also depends upon the conveyor speed. With these factors balanced, delay circuit 57 is adjusted to assure that vacuum valve 56 remains open a sufficient amount of time to securely hold and longitudinally stagger rear content element 24 the desired distance for complete visibility. Preferably, delay circuit 57 monitors the actual conveyor speed and only requires the desired visible length of element 24 to be set in order to automatically determine the necessary time delay.

Once the time delay set into circuit 57 has expired, a signal is sent to vacuum valve 56 to close the vacuum valve. This allows rear content element 24 to be disengaged from staggering system 20 and advance along channel 39 in the normal manner.

As is apparent from the preceding disclosure, vacuum staggering system 20 of the present invention provides a completely reliable, effective, and fully controllable system for attaining content staggering or longitudinal separation regardless of the configurations of the contents or their arrangements. Although the foregoing detailed discussion is based upon contents wherein the statement is the forward content element and the check is the rear content element, content variations are easily met by the present invention, as well as any alternate configurations.

By completely controlling (1) the force of the vacuum (2) the time between the sensing of the presence of the contents and the initiation of the vacuum force and (3) the time duration through which the vacuum is applied after activating, any envelope content staggering or longitudinal separation can be efficiently and effectively achieved by the present invention. As a result, heretofore unobtainable results are realized.

Although the difficulty encountered with processing envelope contents has existed for decades, no prior art system has been developed which is capable of staggering or longitudinally separating the contents of the envelope in a manner which allows the information contained thereon to be processed without requiring the operator to physically handle the contents. However, by employing the present invention, this prior art failing has been completely eliminated and an efficient, effective, and dependable content staggering or longitudinal separating system has been realized.

In order to further enhance the viewability of content elements 23 and 24 in mail handling system 20, separator tracks 29 and 30 have been modified. As shown in FIGS. 1–4, separator tracks 29 and 30 are constructed with their proximal and distal ends formed in a manner substantially identical to the structure disclosed in U.S. Pat. No. 5,052,875. However, in order to enhance the visibility of content elements 23 and 24, separator track 29 is constructed with elongated rod member 61 forming the central portion of track 29, extending substantially the entire length of mail handling system 21. Similarly, separator track 30 comprises elongated rod 62 as its central portion, extending substantially the entire length of mail handling system 21.

The incorporation of elongated rod 61 and 62 provides a substantially reduced thickness to separator tracks 29 and 30 along the length of mail handling system 21 in the area where the operator is required to view and handle the envelope contents. By substantially reducing the thickness in this zone, content elements 23 and 24 are arcuately pivoted rearwardly, into a plane which is more acute to belt 25 than was achieved in the previous embodiment. In this way, envelope contents 23 and 24 are more easily viewed by the operator for improved visual processing prior to handling.

In order to attain a content staggering or longitudinally separating system, in accordance with the present invention, various alternate methods can be employed. As detailed above, vacuum system 20 provides an efficient, effective, and reliable construction for attaining the desired content staggering or longitudinal separation. However, other constructions can be employed to attain the staggering or longitudinal separation of the present invention, by employing alternate methods for achieving the desired result of this invention. One such alternate method employs mechanical means, such as rollers, as depicted in FIGS. 6 and 7.

The two systems taught herein are considered to be representative of the various constructions than can be employed for attaining the desired longitudinal separation or staggering. However, the present invention is not intended to be limited to these constructions. It is to be understood that alternate systems employing mechanical, vacuum, electrical, or chemical arrangements can be constructed without departing from the scope of this invention.

Figure 6:
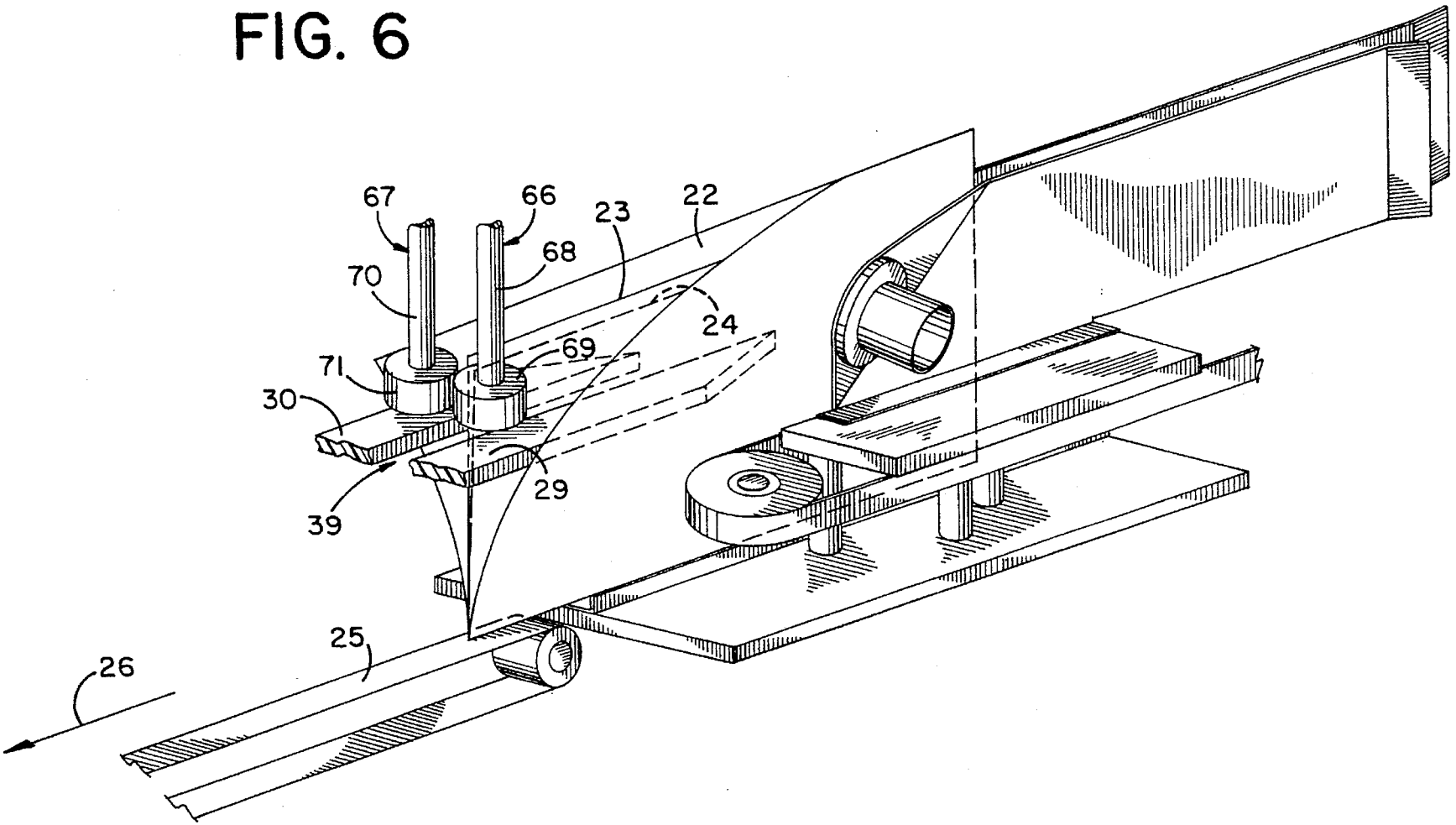
FIGS. 6 and 7 are perspective views, partially broken away, similar to FIG. 2, depicting an alternate embodiment of the content staggering system of this invention.
Figure 7:
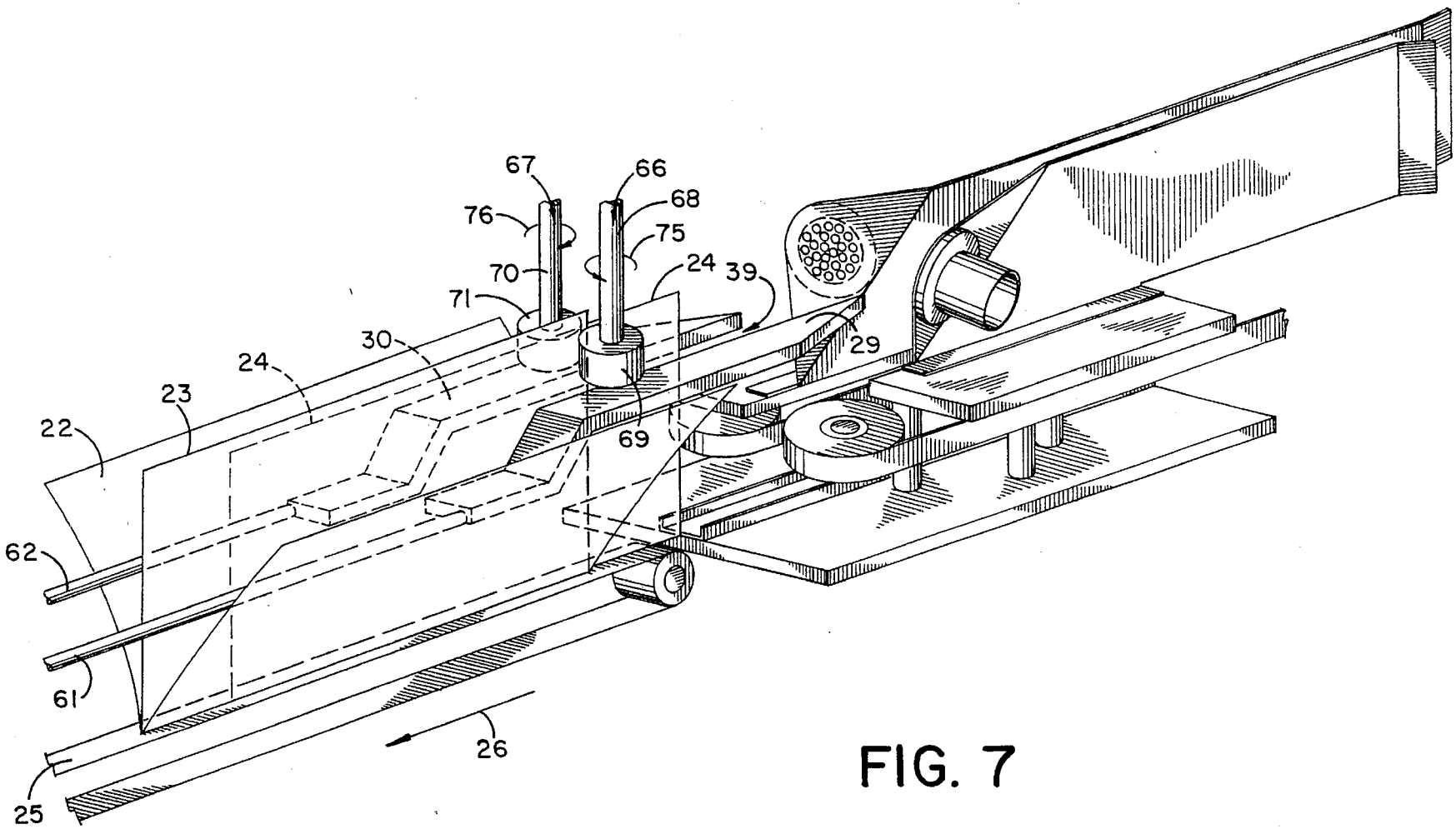

In FIGS. 6 and 7, mail handling system 21, substantially identical to the construction detailed above, is employed. However, in this construction, pinch roller assemblies 66 and 67 are employed to attain the desired longitudinal separation or staggering.

In the preferred construction, pinch roller assembly 66 comprises an elongated shaft 68 which is rotationally journaled in conventional drive equipment in a conventional manner. For purposes of clarity, the drive system is not depicted. However, as shown in FIGS. 6 and 7, a roller 69 is fixedly mounted to the distal or terminating end of shaft 68, in a manner which assures that roller 69 rotates with shaft 68.

In a similar construction, pinch roller assembly 67 comprises an elongated shaft 70 and a roller 71 securely affixed to the distal end of shaft 70. In a manner similar to shaft 68, shaft 70 is also rotationally driven by conventional equipment to assure that shaft 70 and roller 71 continuously rotate about the central axis of shaft 70.

In this embodiment, content elements 23 and 24 advance in pathway or channel 39 into contact with continuously rotating pinch rollers assemblies 66 and 67. In order to obtain the desired staggering or longitudinal separation of rear content element 24 from the forward content element 23, pinch roller assemblies 66 and 67 are rotated either at different speeds or in opposite directions.

In the preferred embodiment, pinch roller assembly 66 is rotated in the direction of arrow 75, as shown in FIG. 7, while pinch roller assembly 67 is rotated in the direction of arrow 76. However, the rotational speed of pinch roller assembly 67 is substantially less than the rotational speed of pinch roller assembly 66. Furthermore, in the preferred embodiment, the rotational speed of pinch roller assembly 66 is selected to complement belt 25, so that the advance of envelope 22 and forward content element 23 continues in a generally normal, free-flowing manner.

In order to obtain the desired longitudinal separation or staggering of rear content element 24, pinch roller assembly 67 is rotated in the direction of arrow 76 at a rate of speed less than the rate of speed of pinch roller assembly 66. In this way, the advance of rear content element 24 is slowed as content elements 23 and 24 simultaneously pass between pinch roller assemblies 66 and 67.

With pinch roller assembly 67 rotationally turning at a slower speed than pinch roller assembly 66, rear content element 24 is forced to slide on the surface of the faster moving forward content element 23, as the two content elements advance along mail handling system 21. As depicted in FIG. 7, once content elements 23 and 24 have advanced substantially in their entirety through pinch roller assemblies 66 and 67, the desired staggering or longitudinal separation of rear content element 24 relative to forward content element 23 is attained.

In addition to having the pinch roller assembly 66 and 67 rotating at different speeds, pinch roller assembly 66 and 67 may be constructed for rotating in a plurality of alternate ways. If desired, pinch roller assembly 67 may be rotated in the direction opposite of arrow 76 for a short time, for actively forcing rear content element 24 rearwardly as forward content element 23 is advanced forwardly. Of course, in this configuration, the distance between roller 69 and 71 must be carefully controlled, based upon the thickness of content elements 23 and 24, since the rollers would be moving in opposite directions.

Furthermore, roller assemblies can be employed which advance into and out of contact with content elements 23 and 24, instead of being continuously mounted for rotation, as depicted in FIGS. 6 and 7. However, although a plurality of alternate structural arrangements can be employed for attaining the desired separation, these alternate constructions are all obvious variations of the present invention for attaining the staggering or longitudinal separation of content elements 23 and 24, as disclosed herein.

It will thus be seen that the objects set forth above, among those made apparent from the preceding description, are efficiently attained and, since certain changes may be made in the above construction without departing from the scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

Having described my invention, what I claim as new and desire to secure by Letters Patent is:

1. A system for use with automated envelope handling equipment constructed for opening mail-type envelopes, each envelope having two or more indicia bearing elements forming a group of contents with each element having a fixed length defined by a leading edge and a trailing edge, and displaying the contents, said system comprising A. means for independently and separately transferring each group of indicia bearing elements forming the envelope contents along a desired pathway in substantially a same plane;

B. means for longitudinally separating the elements forming the envelope contents into an overlying, juxtaposed, longitudinally staggered relationship with a substantially single planar relationship being maintained and presenting each of the indicia bearing elements with at least a portion of said indicia of each element being visible simultaneously with portions of the indicia of the other elements as the elements are advanced together along the desired pathway; and C. a display zone forming a part of the pathway and constructed for enabling the separated, indicia-bearing elements of each content group to be simultaneously advanced therethrough in substantially a single plane with at least a portion of the indicia of each element being simultaneously visible, whereby said system enables individuals to simultaneously read the visible indicia on each element as the elements pass through the display zone, without manually touching the elements forming the content group.

2. The system defined in claim 1, wherein the envelope contents are further defined as comprising a first and a second separate and independent element forming a forward element and a rear element and the element separating means are further defined as separating the elements to simultaneously present the first element in its entirety and at least 10% of the second element.

3. The system defined in claim 2, wherein said separating means are further defined as being cooperatively associated with the rear element for altering the movement of the rear element relative to the movement of the forward element, causing at least a portion of the rear element to longitudinally extend beyond a terminating end of the forward element for complete visibility of said portion, as the forward and rear element progress through the desired pathway.

4. The system defined in claim 3, wherein the portion of the rear element extending beyond the trailing edge of the forward element is further defined as comprising at least one inch.

5. A system for use with automated envelope handling equipment constructed for opening envelopes having at least a first element and a second element contained therein, with each element having a fixed length defined by a leading edge and a trailing edge and for displaying the elements substantially independently of the envelope, said system comprising A. means for transferring the elements along a desired pathway in substantially a same plane while maintaining at least portions of the elements in juxtaposed, overlying contacting relationship, B. means mounted in cooperating relationship with the envelope elements' pathway and constructed for altering the position of the elements into an overlying, juxtaposed, longitudinally staggered relationship with a substantially singular planar relationship being maintained and with the first element being positioned relative to the second element to have its trailing edge extend beyond the trailing edge of the second element to enable a portion of the first element to be visible while the second element is simultaneously viewable in its entirety as the first element and second element are transferred together through the desired pathway in substantially a single plane, and C. a display zone forming a part of the pathway and constructed for enabling separated, elements of each content group to be simultaneously advanced therethrough in substantially a single plane with at least a portion of each element being simultaneously visible, whereby said system enables individuals to simultaneously see at least a portion of each element as the elements pass through the display zone, without manually touching the elements forming the content group.

6. The system defined in claim 5, wherein separating means are defined as comprising a pair of roller assemblies positioned along the elements' transfer pathway for frictionally engaging the first element and the second element to cause said elements to be longitudinally separated.

7. The system defined in claim 6, wherein said roller assemblies are further defined as being fixedly mounted along the elements' transfer pathway and maintained in continuous rotation, with the roller assemblies rotating at different speeds, thereby causing the first element to be longitudinally displaced relative to the second element as the first and second element pass between said rotating roller assemblies.

* * * * *